US008167514B2

(12) United States Patent
Leverette et al.

(10) Patent No.: US 8,167,514 B2
(45) Date of Patent: May 1, 2012

(54) STRAKE SYSTEM FOR SUBMERGED OR PARTIALLY SUBMERGED STRUCTURES

(75) Inventors: Steven J. Leverette, Richmond, TX (US); Oriol R. Rijken, Houston, TX (US)

(73) Assignee: Seahorse Equipment Corporation, Houston, TX (US)

( * ) Notice: Subject to any disclaimer, the term of this patent is extended or adjusted under 35 U.S.C. 154(b) by 220 days.

(21) Appl. No.: 12/545,798

(22) Filed: Aug. 21, 2009

(65) Prior Publication Data

US 2011/0044764 A1 Feb. 24, 2011

(51) Int. Cl.
*E02D 5/60* (2006.01)

(52) U.S. Cl. ..... 405/216; 405/211; 405/264

(58) Field of Classification Search ..... 405/203, 405/204, 212, 216, 223.1, 224; 114/264, 114/265

See application file for complete search history.

(56) References Cited

U.S. PATENT DOCUMENTS

| | | | | |
|---|---|---|---|---|
| 6,561,734 | B1 * | 5/2003 | Allen et al. | 405/216 |
| 6,953,308 | B1 * | 10/2005 | Horton | 405/211 |
| 7,413,384 | B2 * | 8/2008 | Horton et al. | 405/224.2 |
| 2006/0153642 | A1 * | 7/2006 | Esselbrugge et al. | 405/216 |
| 2007/0231077 | A1 * | 10/2007 | Burgess | 405/216 |

* cited by examiner

*Primary Examiner* — David Bagnell
*Assistant Examiner* — Benjamin Fiorello
(74) *Attorney, Agent, or Firm* — Nick A. Nichols, Jr.

(57) ABSTRACT

A submerged or partially submerged structure includes one or more non-cylindrical support columns interconnected at the lower ends thereof by horizontally disposed pontoons. The support columns include one or more strakes mounted thereon. The columns and strakes contribute to the stability of the structure during free floating operations and installation by reducing vortex induced motion.

16 Claims, 8 Drawing Sheets

STRAKE SYSTEM FOR SUBMERGED OR PARTIALLY SUBMERGED STRUCTURES

BACKGROUND OF THE INVENTION

The present invention relates to strake systems for submerged structures, such as columns, pipes or the like, and more particularly to a strake system for a tension leg platform (TLP), spar platform or semisubmersible platform.

Conventional multi-column offshore structures, such as semisubmersible platforms, generally have one or more vertical columns interconnected by pontoons supporting a deck above a water surface. Tendons connected at the lower ends of the columns anchor the offshore structure to the seabed. The submerged support columns are exposed to ocean currents which produce vortex induced motion (VIM) resulting in resonant vibratory stresses that weaken and damages the columns. Typically, the support columns of an offshore structure are cylindrical. Helical fins secured on the peripheral surface of the cylindrical columns are known to reduce vortex formation, thus reducing or eliminating VIM. Helical fins, however, have not been shown to reduce vortex formation about non-cylindrical structures, such as square or rectangular columns.

The economics of recovering oil and gas located offshore at great depths dictate that the construction cost and payload capacity of offshore platforms, such as multi-column submersibles, be optimized. Incorporating non-cylindrical columns in the platform design yields efficiencies in construction and less cost. However, non-cylindrical columns can be as susceptible to vibratory movement as cylindrical columns. This disadvantage may be overcome by mounting strakes on the non-cylindrical columns of the platform in accordance with the present invention which will substantially reduce or eliminate VIM.

SUMMARY OF THE INVENTION

In accordance with a preferred embodiment of the present invention, a submerged or partially submerged structure includes one or more non-cylindrical support columns interconnected at the lower ends thereof by horizontally disposed pontoons. The support columns include one or more strakes mounted thereon. The strakes alter the flowfield and the fluid-structure interaction which results in a reduction of vortex induced motion.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
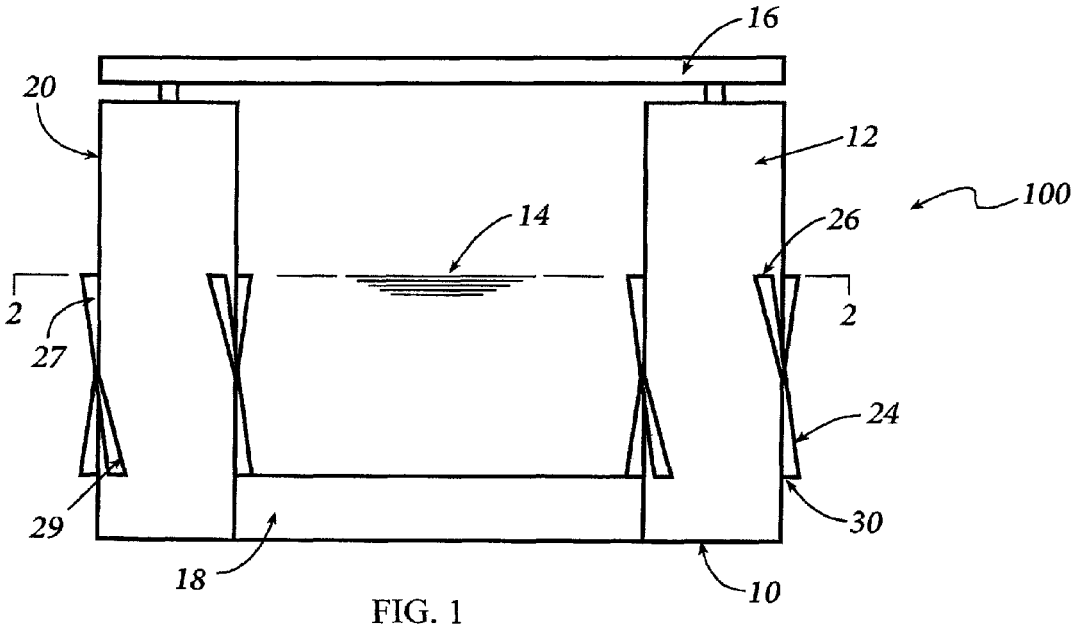
FIG. 1 is a side elevation view of a first embodiment of a submersible or partially submersible structure constructed in accordance with the present invention.

Referring first to FIG. 1, a first embodiment of the strake system of the present invention generally identified by the reference numeral 100 is shown applied to a semisubmersible platform 10. The platform 10 includes four columns 12 having upper ends projecting above the water surface 14 for engaging and supporting a platform deck 16 thereon. Horizontally disposed pontoons 18 interconnect adjacent columns 12 proximate the lower ends thereof. The platform 10 is anchored to the seabed by mooring lines in a well known manner.

The columns 12 and pontoons 18 form an open structure hull 20 for supporting the deck 16 and the equipment mounted thereon above the water surface 14. The deck 16 is supported above the water surface 14 on the upper ends of the columns 12. The open structure of the columns 12 and pontoons 18 provides improved wave transparency and further defines a moonpool 22 providing access to the seabed from the deck 16.

Figure 2:
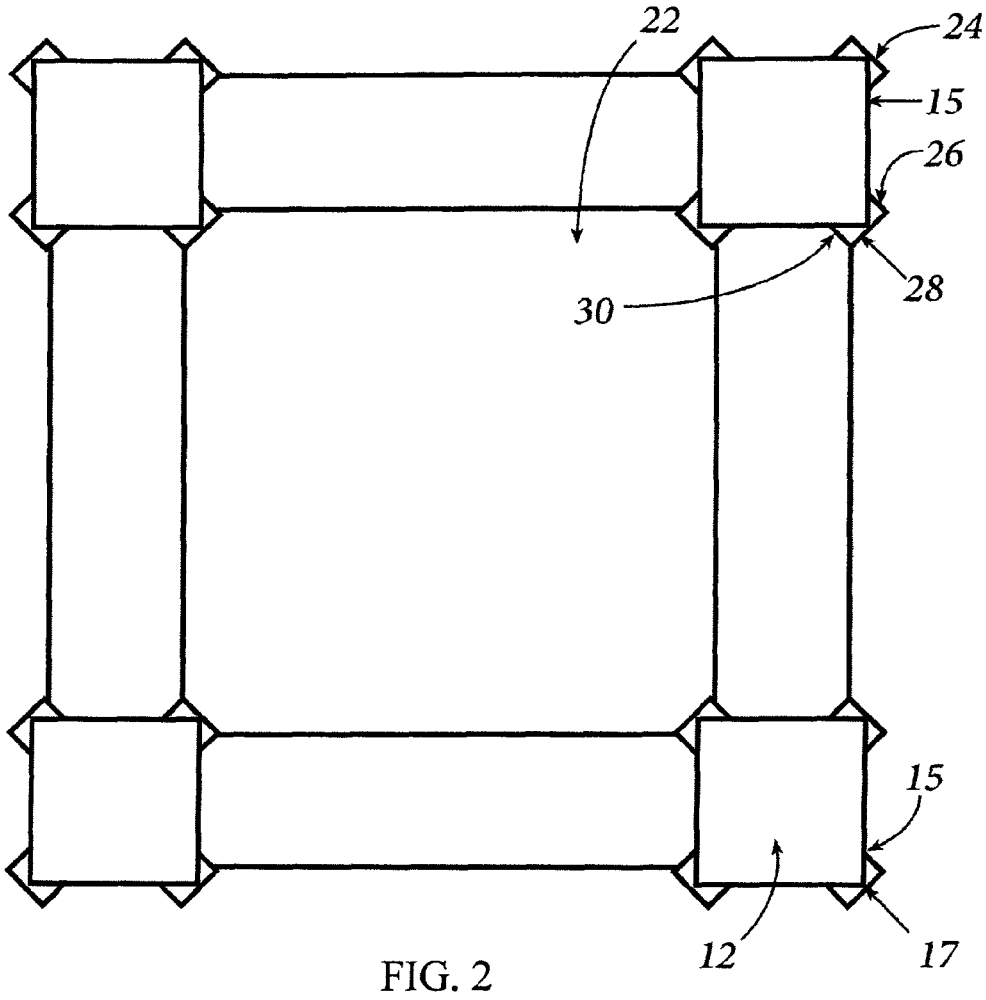
FIG. 2 is a section view taken along line 2-2 in FIG. 1.

In accordance with the present invention, the columns 12 are non-cylindrical. In FIG. 2, columns 12 are shown as being square or rectangular in cross section but other configurations, such as triangular columns, are within the scope of the invention. The columns 12 include flat or planar sidewalls 15 fabricated of steel or other suitable material. Adjacent sidewalls 15 meet at the longitudinal edges thereof to form the corners 17 of the columns 12. Strakes 24 are mounted on the columns 12 and extend as longitudinal fins on the columns 12 from just below the water surface 14 and terminate above the pontoons 18. The strakes 24 are welded or otherwise fixed to the sidewalls 15 of the columns 12.

For purposes of this disclosure, the term "strake" means a structure mounted adjacent to or across a corner 17 on the columns 12. The terms "strake system" means multiple strakes fixed on a single column. The term "fin" means the substantially flat components that form a strake. A fin may have a tapered cross section or may define a substantially flat plate.

Figure 3:
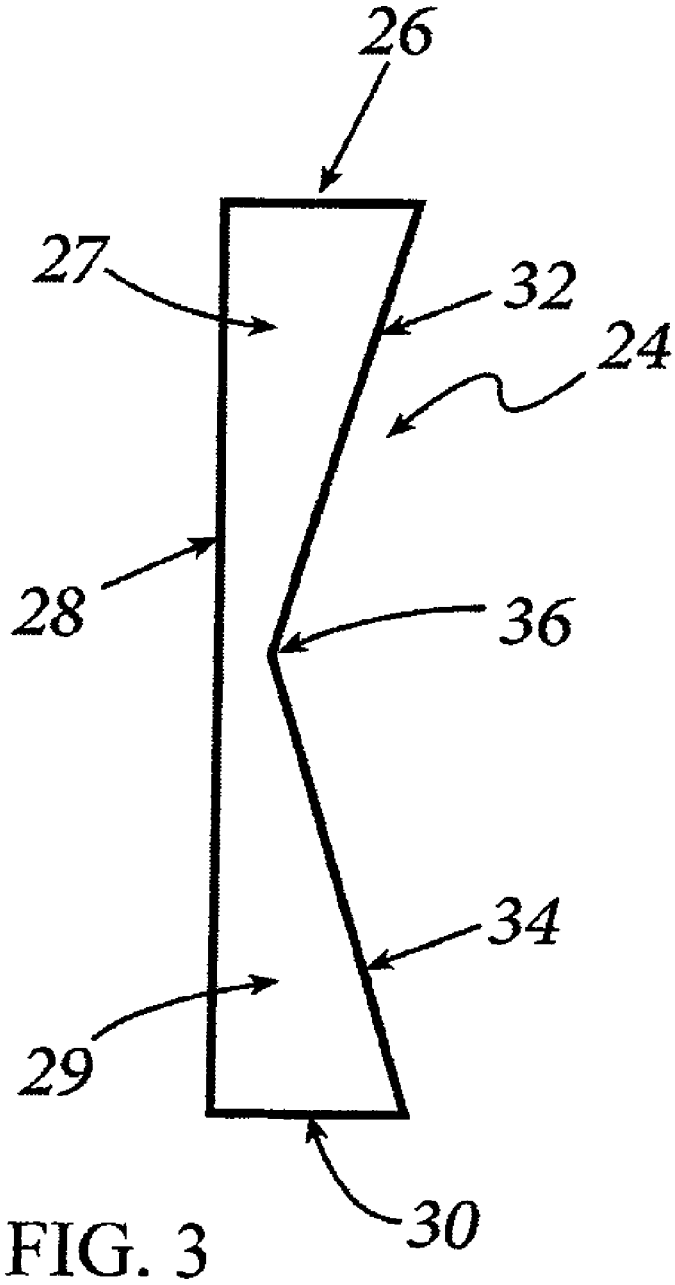
FIG. 3 is a plan view of a support column strake of the present invention.
Figure 5:
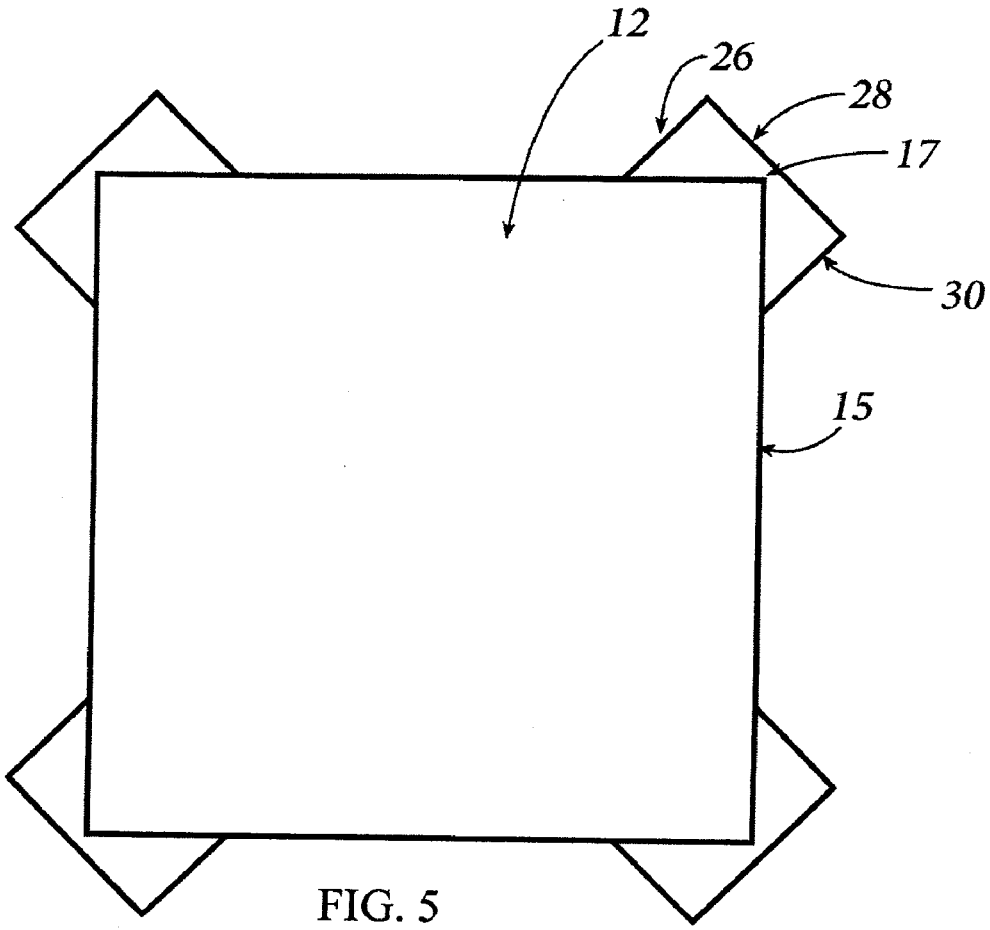
FIG. 5 is a top plan view of the support column of the present invention shown in FIG. 4.

Referring now to FIG. 3, a strake 24 of the invention is shown in plan view. The strake 24 comprises a substantially planar plate fabricated of steel or other suitable material about ¾ of an inch thick. The strake 24 has an upper portion or fin 27 and a lower portion or fin 29. The fin 27 is defined by an upper edge 26, a longitudinal edge 28 and an inwardly extending edge 32. The fin 29 is defined by a lower edge 30, the longitudinal edge 28 and an inwardly extending edge 34. The edges 32 and 34 extend from the upper and lower edges 26 and 30, respectively, to a strake midpoint 36. The upper and lower edges 26 and 30 define the maximum height or distance that the strakes 24 project from the sidewalls 15 of the columns 12. The minimum height of the strakes 24 is at the midpoint 36 thereof. At least two of the strake edges of the strake system 100 project outside the perimeter of the columns 12 for all angles of rotation of the columns 12 about a vertical axis, as shown in FIG. 5.

The strakes 24 are welded or otherwise secured to the columns 12 across the corners 17 thereof so that the fin 27 of a strake 24 is secured to one sidewall 15 of the columns 12 and the fin 29 thereof is fixed to an adjacent sidewall 15. The corners 17 of the columns 12 intersect the strakes 24 at the strake midpoint 36. One or more strakes 24 mounted on a single column 12 comprise the strake system 100.

Figure 4:
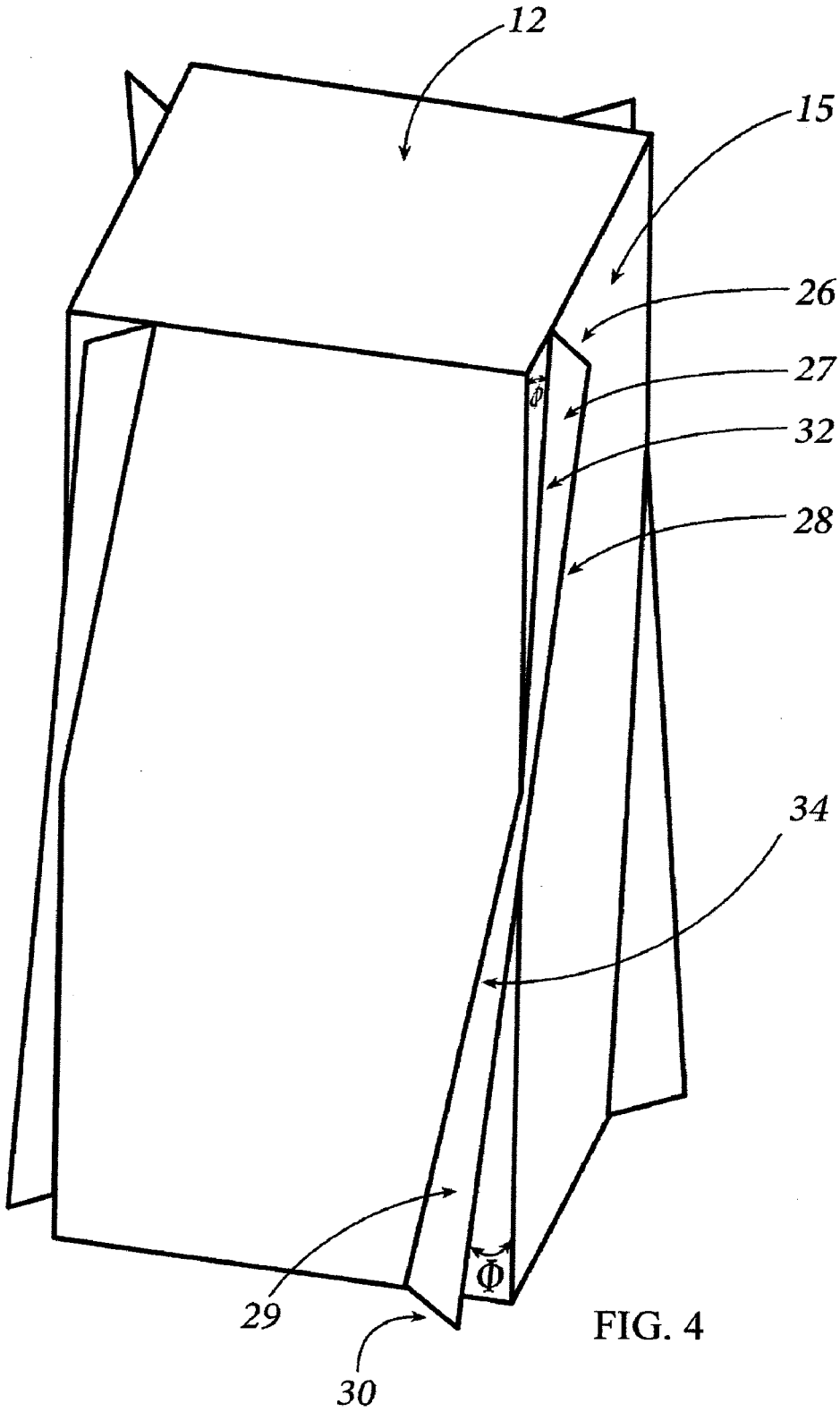
FIG. 4 is a perspective view of a support column of the present invention.

The strakes 24 are secured to the sidewalls 15 at an angle Φ relative the corners 17 of the columns 12, as best shown in FIG. 4. The angle Φ is in the range of about 30° to 45° providing a 60° to 90° total wrap around effect on the columns 12. The upper and lower fins 27 and 29 of each strake 24 extend across more than 10% of the width of the sidewalls 15 of the columns 12. The central longitudinal portions of the column sidewalls 15 are unobstructed, thereby permitting risers, flowlines or the like to be hung off the columns 12.

Figure 6:
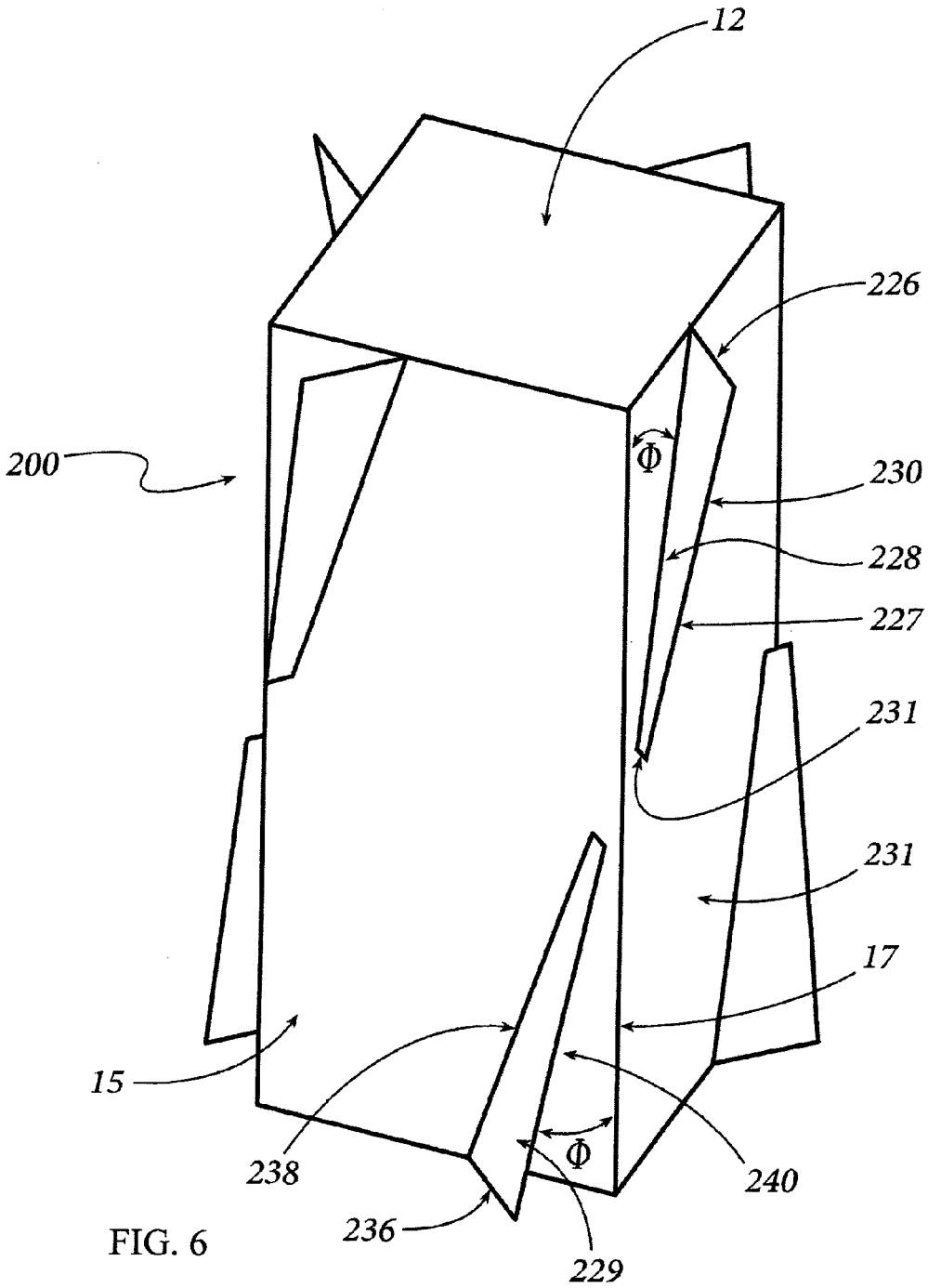
FIG. 6 is a perspective view of a second embodiment of a submersible or partially submersible structure constructed in accordance with the present invention.
Figure 7:
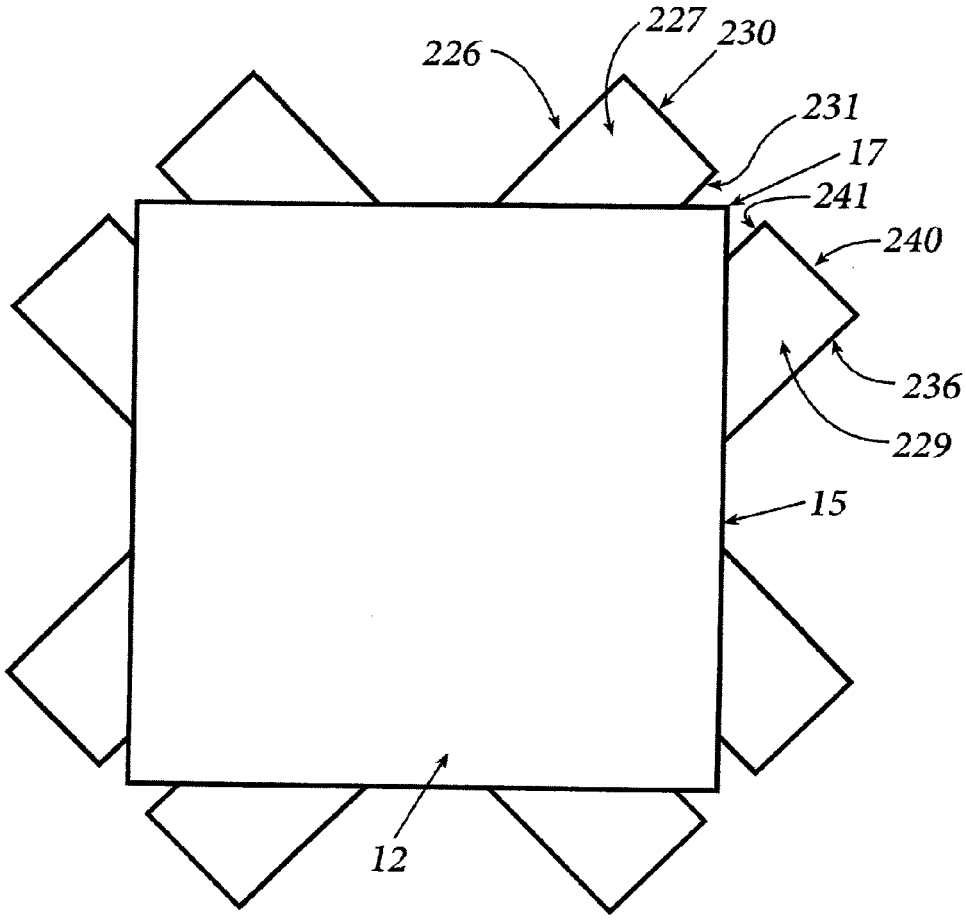
FIG. 7 is a top plan view of the support column of the present invention shown in FIG. 6.

Referring now to FIGS. 6 and 7, a second embodiment of the strake system of the present invention generally identified by reference numeral 200 is shown. The strake system 200 is substantially similar to the strake system 100 described above with reference to FIGS. 1-5, with the exception that the strakes of the strake system 200 do not comprise a single unitary body having upper and lower fins. As shown in FIG. 6, the strake system 200 comprises separate upper strake fins 227 and lower strake fins 229 fixed on the sidewalls 15 of the support columns 12. The upper strake fins 227 are defined by an upper edge 226, a longitudinal edge 228, an inclined edge 230 and a distal edge 231. The upper edge 226 and distal edge 231 of the upper strake fins 227 define a local maximum and a local minimum height, respectively. That is the upper edge 226 and distal edge 231 define the maximum and minimum distance, respectively, the upper strake fins 227 project from the sidewalls 15 of the columns 12. Likewise, the lower strake fins 229 are defined by a lower edge 236, a longitudinal edge 238, inclined edge 240 and a distal edge 241. The lower edge 236 and distal edge 241 of the lower stake fins 229 define a local maximum and local minimum height, respectively, or the maximum and minimum distance the lower strake fins 229 project from the sidewalls 15 of the columns 12. The upper strake fins 227 and the lower strake fins 229 are laterally offset from the corners 17 of the columns 12.

The strake fins 227 and 229 are fixed to the sidewalls 15 of the support columns 12 at an angle Φ relative the corners 17 of the support columns 12 providing a total wrap around effect as discussed above. The strake fins 227 and 229 are arranged on the support columns 12 in cooperating pairs. That is the support columns 12 include an upper strake fin 227 at an angle on a sidewall 15 and a corresponding lower strake fin 229 at an angle Φ fixed to an adjacent sidewall 15 of the support columns 12.

Figure 8:
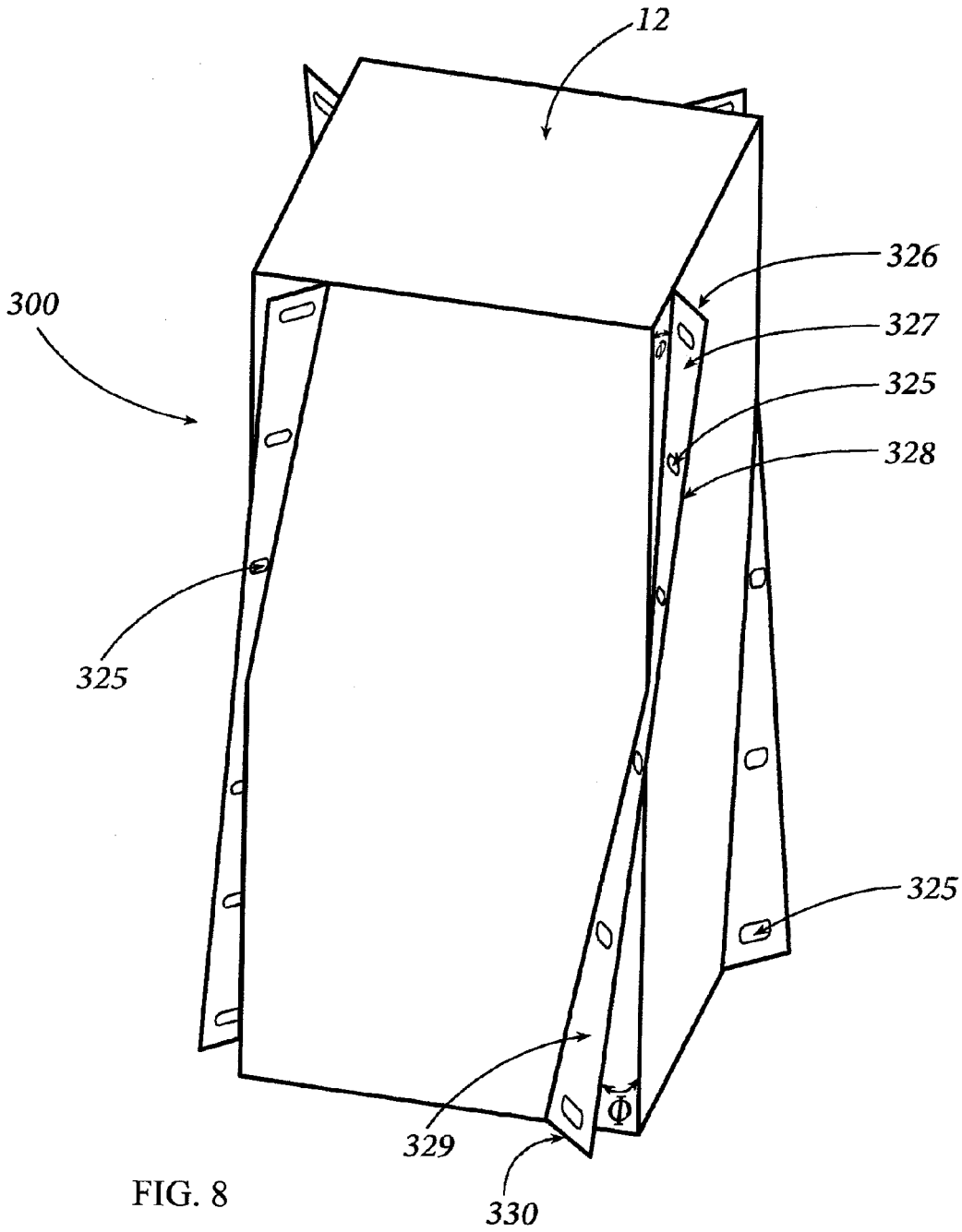
FIG. 8 is a perspective view of a third embodiment of a submersible or partially submersible structure constructed in accordance with the present invention.

Referring now to FIG. 8, a third embodiment of the strake system of the present invention generally identified by reference numeral 300 is shown. The strake system 300 is substantially similar to the strake system 100 described above with reference to FIGS. 1-5, with the exception that the strakes of the strake system 300 include holes or slots 325 extending through the upper and lower strake fins 327 and 329. The upper edge 326 and lower edge 330 define the maximum height or distance the strakes project from the sidewalls 15 of the columns 12. The slots 325 may extend from the edge 328 to near or at the support column 12. The slots 325 may include various shapes and sizes that may affect the hydrodynamic response of the submerged or partially submerged structure.

Several strake designs of the present invention have been described herein, however, it is understood that other strake designs may be utilized that may affect the hydrodynamic response of a submerged or partially submerged structure. For example, as shown in FIG. 8 the upper and lower stake edges, such as the upper edge 326 and the lower edge 330, may not be parallel or horizontal but instead define a curved or tapered profile.

While preferred embodiments of the invention have been shown and described, other and further embodiments of the invention may be devised without departing from the basic scope thereof, and the scope thereof is determined by the claims which follow.

The invention claimed is:

1. A strake system for reducing vortex induced motion of a submerged or partially submerged structure, comprising:

a) at least one support column extending upwardly to an elevation above a water surface;

b) said support column including at least two sidewalls joined along a respective longitudinal edge forming a longitudinal corner at the point of juncture;

c) at least one strake secured on said support column, said strake intersecting said longitudinal corner of said support column at an angle Φ relative to said longitudinal corner; and d) wherein said strake comprises a substantially planar body having a first edge defining a first longitudinal side of said body, a second edge defining an upper end of said body, a third edge defining a lower end of said body, a fourth edge defining a second longitudinal side of said body, and wherein said fourth edge includes a first segment extending downwardly from said second edge at an angle less than 90° relative to said second edge and a second segment extending upwardly from said third edge at an angle less than 90° relative to said third edge.

2. The system of claim 1 wherein said second and third edges are oriented substantially perpendicular to said first edge.

3. The system of claim 2 wherein said second edge and said third edge define a curved or tapered profile.

4. The system of claim 1 wherein said strake intersects said longitudinal corner of said support column at an angle between 0° to 90°.

5. The system of claim 1 wherein said strake extends across less than 50% the width of said sidewalls of said support column.

6. The system of claim 1 wherein said angle Φ is in the range of 30° to 45°.

7. The system of claim 1 wherein said strake includes an upper strake fin fixed to one of said sidewalls of said support column and a separate lower strake fin fixed to an adjacent other of said sidewalls of said support column, wherein said upper strake fin and said lower strake fin are fixed to each respective said sidewalls at an angle Φ relative to said longitudinal corner of said support column and are laterally offset from said longitudinal corner of said support column.

8. The system of claim 1 including one or more apertures extending through said strake body.

9. The system of claim 1 wherein at least two of said strake edges project outside the perimeter of said support column for all angles of rotation about a vertical axis.

10. An offshore structure, comprising:

a) a hull including at least one support column extending upwardly to an elevation above a water surface;

b) said support column including at least two sidewalls joined along a respective longitudinal edge forming a longitudinal corner at the point of juncture;

c) at least one strake secured to said support column, said strake intersecting said longitudinal corner of said support column at an angle Φ relative to said longitudinal corner; and d) wherein said strake comprises a substantially planar body having a first edge defining a first longitudinal side of said body, a second edge defining an upper end of said body, a third edge defining a lower end of said body, a fourth edge defining a second longitudinal side of said body, and wherein said fourth edge includes a first segment extending downwardly from said second edge at an angle less than 90° relative to said second edge and a second segment extending upwardly from said third edge at an angle less than 90° relative to said third edge.

11. The offshore structure of claim 10 wherein said second and third edges are oriented substantially perpendicular to said first edge.

12. The offshore structure of claim 10 wherein said strake intersects said longitudinal corner of said support column at an angle between 0° to 90°.

13. The offshore structure of claim 10 wherein said strake extends across less than 50% the width of said sidewalls of said support column.

14. The offshore structure of claim 10 wherein said angle Φ is in the range of 30° to 45°.

15. The system of claim 10 wherein said strake includes an upper strake fin fixed to one of said sidewalls of said support column and a separate lower strake fin fixed to an adjacent other of said sidewalls of said support column, wherein said upper strake fin and said lower strake fin are fixed to each respective said sidewalls at an angle Φ relative to said longitudinal corner of said support column and are laterally offset from said longitudinal corner of said support column.

16. A strake for reducing vortex induced motion of a submerged or partially submerged structure, comprising:

a) a substantially planar body;

b) a first edge defining a first longitudinal side of said body;

c) a second edge defining an upper end of said body;

d) a third edge defining a lower end of said body;

e) a fourth edge defining a second longitudinal side of said body; and f) wherein said fourth edge includes a first segment extending downwardly from said second edge at an angle less than 90° relative to said second edge and a second segment extending upwardly from said third edge at an angle less than 90° relative to said third edge.

* * * * *